US006772571B1

(12) United States Patent
Sorkin

(10) Patent No.: US 6,772,571 B1
(45) Date of Patent: Aug. 10, 2004

(54) UPPER BEAM BOLSTER FOR USE IN CONSTRUCTION

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 113 days.

(21) Appl. No.: 10/223,042

(22) Filed: Aug. 19, 2002

(51) Int. Cl.[7] ..... E04C 5/16
(52) U.S. Cl. ..... 52/688; 52/684; 52/677
(58) Field of Search ..... 52/677, 679–683, 52/687, 688, 712, 715, 357, 360, 684; 404/135, 136

(56) References Cited

U.S. PATENT DOCUMENTS

| | | | | | |
|---|---|---|---|---|---|
| 859,511 | A | * | 7/1907 | Nolte | 53/372 |
| 875,975 | A | * | 1/1908 | Anderson et al. | 52/341 |
| 2,364,603 | A | * | 12/1944 | Coxon | 15/250.17 |
| 3,033,087 | A | * | 5/1962 | Hillberg | 404/62 |
| 3,114,221 | A | * | 12/1963 | Eriksson | 52/684 |
| 3,289,378 | A | * | 12/1966 | Carroll | 52/688 |
| 4,060,954 | A | * | 12/1977 | Liuzza | 52/677 |
| 4,168,423 | A | * | 9/1979 | Gilreath | 219/402 |
| 4,213,281 | A | * | 7/1980 | Zarzosa-Castilla et al. | 52/323 |
| 4,498,270 | A | * | 2/1985 | Ilukowicz | 52/685 |
| 4,689,867 | A | * | 9/1987 | Tolliver | |
| 4,756,641 | A | * | 7/1988 | Hartzheim | 404/136 |
| 5,356,289 | A | * | 10/1994 | Watanabe | 433/8 |
| 5,502,942 | A | * | 4/1996 | Gras et al. | 52/511 |
| 5,664,390 | A | | 9/1997 | Sorkin | |
| 2003/0009978 | A1 | * | 1/2003 | Haslem et al. | 52/677 |

OTHER PUBLICATIONS

Conas Brochure, "Semifix–Beam Bolsters" and "U–Fix–S-lab Bolsters", circa 1993, p. 4.
Meadow Steel Products Brochure, "Beam Bolsters", 1994, p. 3.

* cited by examiner

*Primary Examiner*—Robert Canfield
(74) *Attorney, Agent, or Firm*—Harrison & Egbert

(57) ABSTRACT

A bolster for use in construction having a plurality of leg members arranged in generally parallel spaced relationship, a beam integrally formed with the plurality of leg members and extending transversely across the plurality of leg members, and a plate affixed to the bottom of the plurality of leg members and having a generally flat bottom surface. The plate has at least one clip formed on a top surface thereof for fixedly receiving a foot associated with at least one of the leg members.

10 Claims, 2 Drawing Sheets

UPPER BEAM BOLSTER FOR USE IN CONSTRUCTION

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to bolsters that are used in construction activities for the support of post-tension cables, rebars or mesh. More particularly, the present invention relates to upper beam bolsters that are designed for support on underlying layers of mesh and rebar or on slab-on-grade surfaces. Additionally, the present invention relates to plates that can be attached to the existing bolsters so as to convert such bolsters for upper beam use.

BACKGROUND OF THE INVENTION

Bolsters are commonly used in the construction industry for the support of post-tension cables, rebars, or mesh above a surface. Typically, when such materials are used, they must be supported above the surface when the concrete is poured. These bolsters are used with poured decks. In normal use, the bolster is positioned on the deck and includes a beam which extends across a plurality of leg members. This beam is formed so as to contact and support the rebar while the base of the bolster rests on the deck or on a grade. When the concrete is poured, the bolster will support the rebar a proper distance above the bottom surface.

In normal use, such bolsters are preformed so that they can be installed quickly and easily upon the deck. Conventionally, the preformed bolster will have a plurality of leg members and a steel rod welded to a top surface of each of the leg members. The rod will serve as a receiving area for the rebar. Conventionally, these bolsters are formed in preset lengths. If it is necessary to extend the bolster across a long surface of the deck, then the ends of the beams of adjacent bolsters will be wired together such that the bolsters are in an end-to-end relationship.

The most common bolster that is employed is a metal bolster manufactured by Meadow Steel Products of Tampa, Fla. This bolster has a plurality of inverted U-shaped leg members having outwardly extending foot portions. A rigid tubular rod having a slight waveform pattern formed thereon is welded to the middle of the inverted U-shaped leg members. Each of the leg members is generally arranged in parallel relationship to each other. The feet of each of the leg members will rest on the deck while the rebar is supported. After the concrete has solidified, and the deck is removed, the bottom surfaces of the feet will be exposed. As such, it is necessary to coat the feet with an anti-rust material. Alternatively, stainless steel material can be employed for the leg members and their associated feet.

Corrosion and cost are major problems affecting the bolster of Meadow Steel Products. In order to form such a bolster, a great deal of manufacturing must take place, including metal forming, bending, dipping, and welding.

These activities, along with the cost of the material used to form the bolster, make the cost of the bolster relatively expensive. If the bolster is not coated or made of a stainless steel material, then corrosion can adversely affect the product. This corrosion can even occur when the metal is coated.

In the past, various attempts have been made to create bolsters of plastic material that can serve the purposes of the bolster of Meadow Steel Products. In general, such efforts have resulted in plastic chairs that are ineffective, cumbersome to use, or unable to properly withstand the forces imparted by the rebar upon the bolster. One such plastic bolster, manufactured by Conac, includes a central beam which is integrally formed with a plurality of leg members. Each of the leg members extends downwardly so as to present a flat surface to the underlying deck. No feet are provided which allow the bolster to be stapled to the deck. Additionally, the configuration of this Conac bolster allows for easy deformation. It is very difficult and time consuming to join lengths of the Conac bolster together. The Conac bolster also lacks the suitable wave form pattern for the receipt of the rebar on the top surface of the bolster. This plastic bolster is often broken, collapsed, or tipped over in actual use. The base of such a bolster has only a very small area of contact with the deck. As such, these plastic bolsters lack the strength and ability to withstand the loads imparted to them.

U.S. Pat. No. 5,664,390, issued on Sep. 9, 1997 to the present inventor, describes a bolster for use in construction. This bolster has a plurality of leg members arranged in parallel relationship and a beam integrally formed with the plurality of leg members and extending across the plurality of leg members. Each of the plurality of leg members has a foot for contacting the underlying surface. Each of the leg members includes a central body portion, a first leg extending downwardly from one side of the central body portion and a second leg extending downwardly from an opposite side of the central body portion. The foot is formed at an end of each of the first and second legs opposite the central body portion. The foot includes a plurality of pin-like projections extending outwardly from a bottom surface thereof. This bolster is of a type for stapling and fixed attachment to an underlying deck.

Under certain circumstances, such bolsters are required for "upper beam" purposes. Upper beam bolsters are often used upon the top of mesh or layers of strands. The upper beam bolsters are commonly used in highway construction where multiple layers of steel are laid out. Under other circumstances, a widened or flat base is required for slab-on-grade construction. Under certain circumstances, the relatively small and narrow feet would sink into sand or dirt if the bolsters of U.S. Pat. No. 5,664,390 were used on generally unstable surfaces. In other circumstances, upper beam slab bolsters are used on corrugating steel decking so as to be in flat surface-to-surface contact with such steel flat surfaces. As such, a need has developed so as to allow the bolster of U.S. Pat. No. 5,664,390 to be properly adapted for upper beam bolster purposes.

It is an object of the present invention to provide an upper beam slab bolster that is corrosion-proof and relatively inexpensive.

It is another object of the present invention to provide an upper beam bolster which can be made from an easily assemblable combination of a bolster and support plate.

It is another object of the present invention to provide an upper beam bolster that can withstand the forces imparted to it.

It is still a further object of the present invention to provide an upper beam bolster that is easy to manufacture and easy to use.

These and other objects and advantages of the present invention will become apparent from a reading of the attached specification and appended claims.

BRIEF SUMMARY OF THE INVENTION

The present invention is an upper beam bolster for use in construction comprising a plurality of leg members in generally parallel spaced relationship, a beam integrally formed with the plurality of leg members extending transversely across the plurality of leg members and a plate affixed to the plurality of leg members so as to have a generally flat bottom surface.

In the present invention, each of the plurality of leg members comprises a central body portion, a first leg extending downwardly from one side of the central body portion and a second leg extending downwardly from an opposite side of the central body portion. The first leg is in parallel alignment with the second leg. Each of the plurality of leg members comprises a first foot formed at an end of the first leg and extending horizontal outwardly therefrom, and a second foot formed at an end of the second leg and extending horizontal outwardly therefrom.

In the present invention, the plate has a clip means formed in a top surface thereof. The clip means serves to fixedly receive at least one of the first foot and the second foot therein. This clip means includes a first projection extending upwardly from the plate having a shoulder formed thereon and spaced from the plate and a second projection extending upwardly from the plate having a shoulder formed thereon so as to face the shoulder of the first projection. The top surface of the foot is in abutment with the shoulders of the first and second projections. The first projection extends in generally parallel relationship to the second projection. The clip means is suitable for snap-fit receipt on both of the first and second feet.

The plate has a rim extending upwardly peripherally therearound. The first foot and the second foot have an outermost surface interior of and adjacent to this rim.

The beam also has a plurality of supports extending downwardly from an underside thereof. The plate has a plurality of receptacles formed on a top surface thereof. The plurality of receptacles respectively receives the plurality of supports therein. Each of the plurality of supports is a pin member of circular cross-section. Each of the plurality of receptacles has a generally circular opening suitable for receiving the pin member therein.

The plate includes a bracing member extending upwardly from a top surface thereof. This bracing member extends across the plate in transverse relationship to a longitudinal axis of the plate. The plate also has a plurality of holes formed therein so as to open through a thickness of the plate to a bottom surface of the plate.

In an alternative form of the present invention, the present invention is an article in the form of a plate suitable for attachment to a bolster so as to convert a standard bolster for use as an upper beam slab bolster.

DETAILED DESCRIPTION OF THE INVENTION

Figure 1:
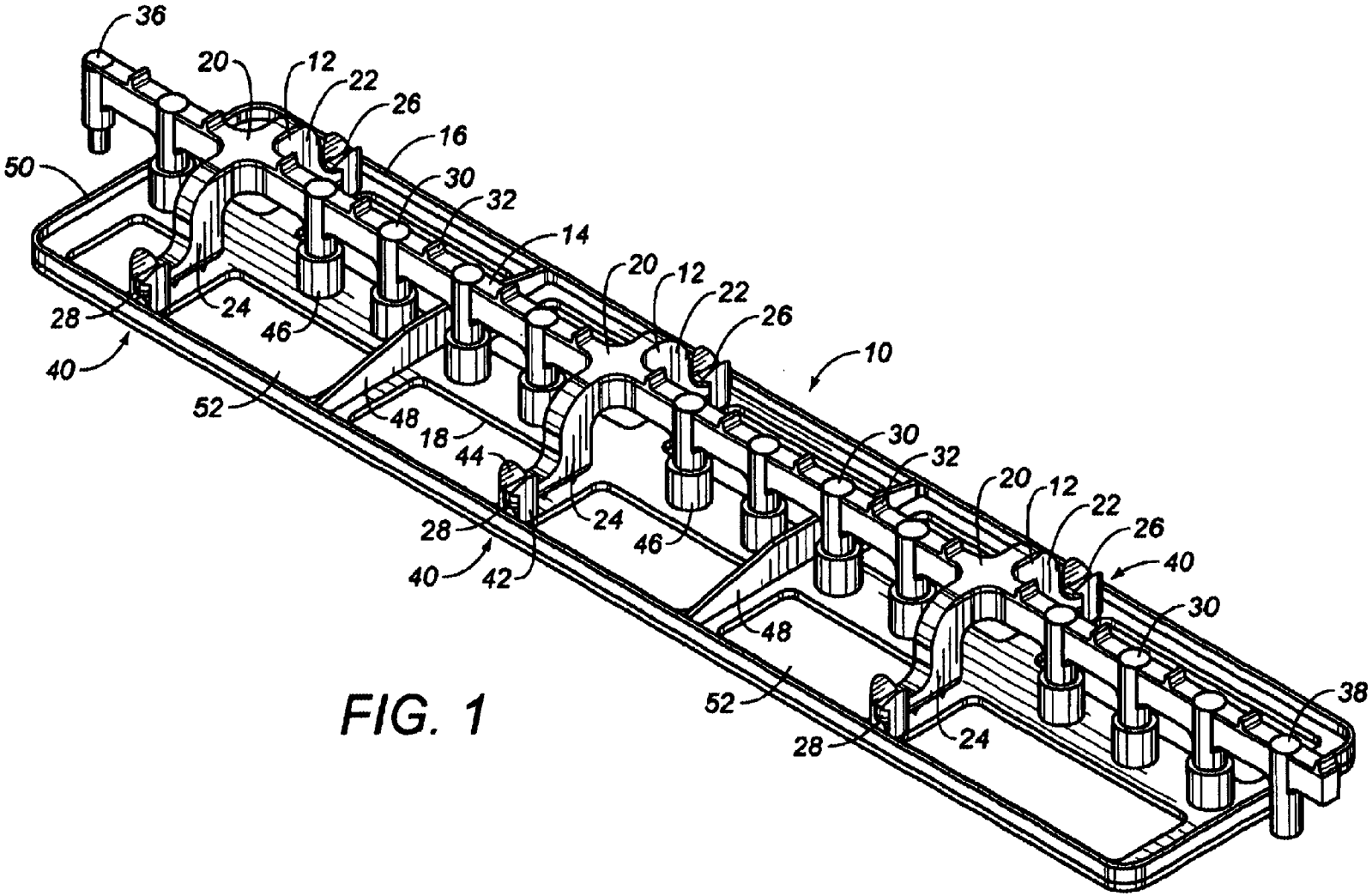
FIG. 1 is an upper perspective view showing the upper beam slab bolster in accordance with the preferred embodiment of the present invention.

Referring to FIG. 1, there is shown the upper beam slab bolster 10 in accordance with the preferred embodiment of the present invention. The upper beam slab bolster 10 includes a plurality of leg members 12 arranged in generally parallel spaced relationship to each other. A beam 14 is integrally formed with the plurality of leg members 12 and extends transversely across the plurality of leg members 12, and a plate 16 is affixed to the plurality of leg members 12. The plate 16 has generally a flat bottom surface 18.

As can be see in FIG. 1, the bolster is made up of the plurality of leg members 12 and the beam 14, in accordance with the teachings of U.S. Pat. No. 5,664,390. Importantly, the plate 16 is configured so as to be affixed to the leg members 12 such that the plate 16 forms an undersurface of the upper beam slab bolster 10 of the present invention. The plate 16 has a particular configuration for being received within the particular construction of the leg members 12 and beam 14 so as to allow the present invention to be adapted for use as a upper beam slab bolster.

Figures 2, 3:
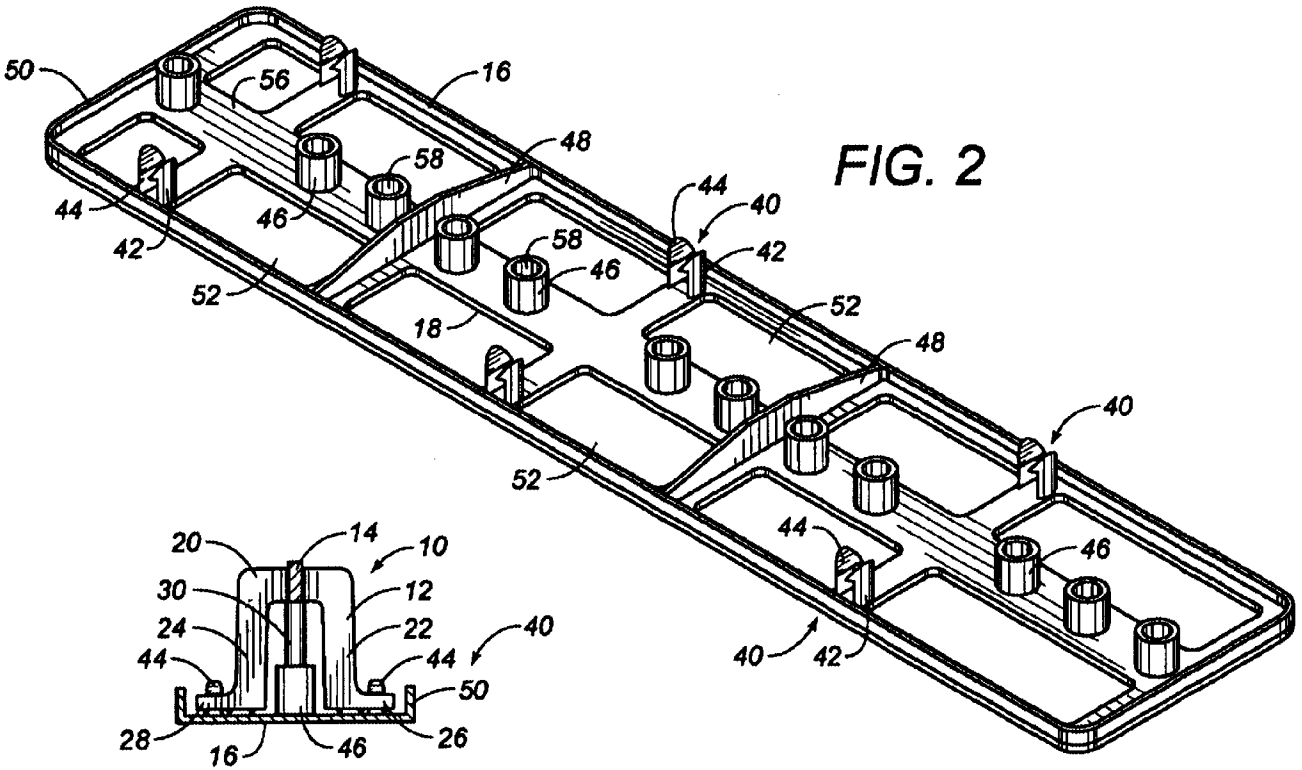
FIG. 2 is an isolated perspective view of the plate as used with the bolster of the present invention.
FIG. 3 is a cross-sectional view showing the connection between the bolster and the plate in accordance with the teachings of the present invention.

In FIG. 1, it can be seen that each of the plurality of leg members includes a central body portion 20, a first leg 22 and a second leg 24. The central body portion 20 is integrally connected with the beam 14. The first leg 22 extends outwardly and downwardly from one side of the central body portion 20. The second leg 24 extends outwardly and downwardly from an opposite side of the central body portion 20. The first leg 22 will be in planar alignment with the second leg 24. The first leg 22 includes a foot 26 formed at an end of the first leg 22 and extending horizontal outwardly therefrom. As can be seen in FIG. 3, this foot 26 has a top surface and a bottom surface. A second foot 28 is formed at the end of the second leg 24 and extends horizontal outwardly therefrom. The second foot 28 also has a top surface and a bottom surface.

The beam 14 is a longitudinal member having a plurality of supports 30 extending downwardly from an underside thereof. The supports are ranged in linear alignment along the length of the beam 14 and in spaced relationship to each other. The supports 30 are configured so as provide support to the beam 14 for supporting large loads on the top surface thereof. A plurality of ridges 32 are formed on the top surface of the beam 14 so as to provide definable areas over which rebar and tendons can extend.

In the present invention, the plurality of leg members 12, the beam 14, the supports 30 and the ridges 32 are integrally formed together of a polymeric material. Each of the supports 30 is a pin-like member of generally circular cross-section. It can be seen that the beam 14 has a pin member 36 at one end thereof and a pin member 38 at a opposite end thereof. Pin members 36 and 38 extend outwardly of the periphery of the plate 16.

In the present invention, the plate 16 has a clip means 40 formed on a top surface thereof. This clip means serves to fixedly receive the feet 26 and 28 of the leg members 12. Each of the clips is of an identical configuration and is in spaced relationship to each other. In particular, the clip means includes a first projection 42 extending upwardly from the plate 16 and having a shoulder formed thereon. The shoulder is suitably spaced from the top surface of the plate 16. A second projection 44 also extends upwardly from the plate 16 and has a shoulder formed thereon so as to face the shoulder of the first projection 42. As can be seen in FIG. 1, the foot 28 is received between the projections 42 and 44 such that the top surface of the foot 28 is in abutment with the shoulders of the projections 42 and 44. The bottom surface of the foot 28 will reside upon the top surface of the plate 16. A similar configuration also applies to the other clips formed along the top surface of the plate 16 for the purposes of receiving the foot 26. Although each of the feet of the leg members 12 of the present invention is received within a particular clip means 40 associated with plate 16, it is possible that a single foot could be received by a single clip on the top surface of the plate or that the clips alternate along the top surface of the plate 16 in a variety of manners. Each of the feet associated with leg members 12 can simply be pushed between the projections 42 and 44 so as to reside juxtaposed between the respective shoulders and the top surface of the plate 16.

Importantly, the plate 16 also includes a plurality of receptacles 46 formed on a top surface thereof. Each of the receptacles 46 receives a respective pin-like support 30 from the beam 14. The receptacles 46 have a generally circular opening so that the pin-like projection of the supports 30 can be inserted therein. The receptacles 46 are spaced from each other so as to correspond with the spacing of the supports 30 along the length of beam 14.

A bracing member 48 is formed on the top surface of the plate 16 and extends upwardly therefrom. The bracing member 48 extends transverse to the longitudinal axis of the plate 16. The construction of the bracing member 48 adds structural integrity to the plate 16. In addition, a rim 50 extends upwardly along the periphery of the plate 16. The rim 50 also adds to the structural integrity of the plate 16 and extends so that the feet 26 and 28 of the leg members 12 will have an exterior surface adjacent the inner surface of the rim 50.

The plate member 16 has a plurality of holes 52 formed therein so as to open through a thickness of the plate 16 to the bottom surface 18. Holes 52 are formed to minimize material requirements and to facilitate the placement of the plate 16 on an underlying surface.

In normal use, the beam 14 of the bolster 10 can be joined to an adjacent beam of an adjacent bolster by connecting the beams 14 in end-to-end relationship in the manner described in U.S. Pat. No. 5,664,390 or in other conventional manners.

FIG. 2 is an isolated view of the plate 16. As can be seen, the plate 16 has a generally rectangular configuration. A plurality of holes 52 are formed through the thickness of the plate 16. The plate 16 has a bottom surface 18 and a top surface 56. The bottom surface 18 is generally flat. A plurality of clip means 40 are formed on the top surface 56 and extend upwardly therefrom. The clip means includes a pair of projections 42 and 44, each having a shoulder thereon for snap-fit receipt of a particular foot member of the legs associated with the beam bolster. A plurality of receptacles 46 are also formed on the top surface 56 and extend upwardly therefrom in generally linear alignment along the center of the plate 16. Each of the receptacles 46 has a circular opening 58 formed therein so as to allow for the insertion of the pin-like supports associated with the beam bolster. A rim 50 extends around the periphery of the plate 16. Similarly, bracing members 48 extend transversely across the plate 16 so as to add structural support thereto while minimizing material and weight requirements of the plate 16.

FIG. 3 shows a cross-sectional view whereby the leg members 12 of the bolster and their respective feet are received within the clip means 40 of the plate 16. In FIG. 3, it can be seen that each of the leg members 12 includes a first leg 22 and a second leg 24 extending downwardly therefrom. Beam 14 is illustrated as positioned centrally of the central body portion 20 of the bolster. A foot 26 extends horizontally outwardly from the bottom of the leg 22. Similarly, a foot 28 extends horizontally outwardly from the bottom of the leg 24. As was described in U.S. Pat. No. 5,664,390, each of the feet 26 and 28 has a plurality of pin-like projections extending downwardly therefrom. In normal use, these pin-like projections serve to embed the feet 26 and 28 into an underlying surface. However, in the present invention, since the underlying surface is the plate 16, the pin-like projections on the underside of the feet 26 and 28 may not be necessary. The plate 16 includes a peripheral rim 50 extending upwardly therefrom so as to be positioned adjacent to the outer surfaces of the feet 26 and 28. A receptacle 46 is positioned centrally on the top surface of the plate 16 so as to receive pin-like support 30 extending downwardly from the beam 14. A projection 44 also extends upwardly from the top surface of the plate 16. The top surface of the feet 26 and 28 abuts the underside of the shoulder associated with projections 44. In this manner, the bolster is securely received within the plate 16. In this configuration, the present invention can be adapted for use as an upper beam slab bolster.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A bolster for use in construction comprising:

a plurality of leg members arranged in generally parallel spaced relationship;

a beam integrally formed with said plurality of leg members, said beam extending transversely across said plurality of leg members; and a plate affixed to said plurality of leg members, said plate having a generally flat bottom surface, each of said plurality of leg members comprising:

a central body portion;

a first leg extending downwardly from said central body portion; and a second leg extending downwardly from an opposite side of said central body portion;

a first foot formed at an end of said first leg and extending horizontally outwardly therefrom, said first foot having a top surface and a bottom surface; and a second foot formed at an end of said second leg and extending horizontal outwardly therefrom, said second foot having a top surface and a bottom surface, said plate having a clip means formed on a top surface thereof, said clip means for fixedly receiving said first foot and said second foot therein.

2. The bolster of claim 1, said first leg being in planar alignment with said second leg.

3. The bolster of claim 1, said clip means comprising:

a first projection extending upwardly from said plate and having a shoulder formed thereon and spaced from said plate; and a second projection extending upwardly from said plate and having a shoulder formed thereon so as to face said shoulder of said first projection, said top surface of said foot being in abutment with the shoulders of said first and second projections.

4. The bolster of claim 3, said first projection extending in generally parallel relationship to said second projection.

5. The bolster of claim 1, said clip means of said plate for snap-fit receiving both of said first foot and said second foot.

6. A bolster for use in construction comprising:

a plurality of leg members arranged in generally parallel spaced relationship;

a beam integrally formed with said plurality of leg members, said beam extending transversely across said plurality of leg members; and a plate affixed to said plurality of leg members, said plate having a generally flat bottom surface, each of said plurality of leg members comprising:

a central body portion;

a first leg extending downwardly from said central body portion; and a second leg extending downwardly from an opposite side of said central body portion;

a first foot formed at an end of said first leg and extending horizontally outwardly therefrom, said first foot having a top surface and a bottom surface; and a second foot formed at an end of said second leg and extending horizontal outwardly therefrom, said second foot having a top surface and a bottom surface, said plate having a rim extending upwardly peripherally therearound, said first foot and said second foot having an outermost surface interior of and adjacent to said rim.

7. The bolster of claim 6, said beam having a plurality of supports extending downwardly from an underside thereof, said plate having a plurality of receptacles formed on a top surface thereof, said plurality of receptacles respectively receiving said plurality of supports therein.

8. The bolster of claim 7, each of said plurality of supports being a pin member of circular cross-section, each of said plurality of receptacles having a generally circular opening.

9. The bolster of claim 6, said plate having a bracing member extending upwardly from a top surface thereof and extending across said plate transverse to a longitudinal axis of said plate.

10. The bolster of claim 6, said plate having a plurality of holes formed therein so as to open through a thickness of said plate to said bottom surface.

* * * * *